US006887133B1

(12) United States Patent
Halley

(10) Patent No.: US 6,887,133 B1
(45) Date of Patent: May 3, 2005

(54) PAD SUPPORT METHOD FOR CHEMICAL MECHANICAL PLANARIZATION

(75) Inventor: David G. Halley, Los Osos, CA (US)

(73) Assignee: Strasbaugh, San Luis Obispo, CA (US)

( * ) Notice: Subject to any disclaimer, the term of this patent is extended or adjusted under 35 U.S.C. 154(b) by 0 days.

(21) Appl. No.: 10/379,962

(22) Filed: Mar. 4, 2003

Related U.S. Application Data

(62) Division of application No. 09/693,148, filed on Oct. 20, 2000, now Pat. No. 6,602,121.

(60) Provisional application No. 60/162,171, filed on Oct. 28, 1999.

(51) Int. Cl.[7] ..... B24B 1/00
(52) U.S. Cl. ..... 451/41; 451/59; 451/63
(58) Field of Search ..... 451/41, 59, 63, 451/285, 287, 288, 289, 290, 342, 1, 31, 451/33, 36

(56) References Cited

U.S. PATENT DOCUMENTS

| | | | | |
|---|---|---|---|---|
| 4,128,968 A | | 12/1978 | Jones | |
| 4,490,948 A | * | 1/1985 | Hanstein et al. | 451/490 |
| 5,542,874 A | | 8/1996 | Chikaki | |
| 5,664,987 A | | 9/1997 | Renteln | |
| 5,792,709 A | | 8/1998 | Robinson et al. | |
| 5,800,253 A | * | 9/1998 | Ikemoto | 451/63 |
| 5,938,504 A | | 8/1999 | Talieh | |
| 6,022,807 A | | 2/2000 | Lindsey et al. | |
| 6,106,369 A | * | 8/2000 | Konishi et al. | 451/41 |
| 6,346,036 B1 | | 2/2002 | Halley | |
| 6,435,957 B1 | | 8/2002 | Stemm | |
| 6,464,574 B1 | | 10/2002 | Halley | |
| 2001/0041650 A1 | | 11/2001 | Senga et al. | |

* cited by examiner

*Primary Examiner*—Timothy V. Eley
(74) *Attorney, Agent, or Firm*—Townsend and Townsend and Crew LLP

(57) ABSTRACT

Embodiments of the invention as directed to supporting a polishing pad that can be easily replaced. In one embodiment, a method for polishing an object comprises coupling a polishing head to a substrate for holding a polishing pad which is smaller in area than the object; applying a resilient mechanical force to the perimeter of the substrate with the polishing head to hold the substrate in place during a polishing operation; placing the polishing pad in contact with the object; and rotating the polishing pad with the polishing head.

9 Claims, 11 Drawing Sheets

PAD SUPPORT METHOD FOR CHEMICAL MECHANICAL PLANARIZATION

This application is a divisional of U.S. patent application Ser. No. 09/693,148, filed Oct. 20, 2000, now U.S. Pat. No. 6,602,121, which is based on and claims the benefit of U.S. Provisional Patent Application No. 60/162,171, filed Oct. 28, 1999, the disclosures of which are incorporated herein by reference.

BACKGROUND OF THE INVENTION

The present invention relates to the manufacture of objects. More particularly, the invention provides a technique including a device for planarizing a film of material of an article such as a semiconductor wafer. However, it will be recognized that the invention has a wider range of applicability; it can also be applied to flat panel displays, hard disks, raw wafers, MEMS wafers, and other objects that require a high degree of planarity.

The fabrication of integrated circuit devices often begins by producing semiconductor wafers cut from an ingot of single crystal silicon which is formed by pulling a seed from a silicon melt rotating in a crucible. The ingot is then sliced into individual wafers using a diamond cutting blade. Following the cutting operation, at least one surface (process surface) of the wafer is polished to a relatively flat, scratch-free surface. The polished surface area of the wafer is first subdivided into a plurality of die locations at which integrated circuits (IC) are subsequently formed. A series of wafer masking and processing steps are used to fabricate each IC. Thereafter, the individual dice are cut or scribed from the wafer and individually packaged and tested to complete the device manufacture process.

During IC manufacturing, the various masking and processing steps typically result in the formation of topographical irregularities on the wafer surface. For example, topographical surface irregularities are created after metallization, which includes a sequence of blanketing the wafer surface with a conductive metal layer and then etching away unwanted portions of the blanket metal layer to form a metallization interconnect pattern on each IC. This problem is exacerbated by the use of multilevel interconnects.

A common surface irregularity in a semiconductor wafer is known as a step. A step is the resulting height differential between the metal interconnect and the wafer surface where the metal has been removed. A typical VLSI chip on which a first metallization layer has been defined may contain several million steps, and the whole wafer may contain several hundred ICs.

Consequently, maintaining wafer surface planarity during fabrication is important. Photolithographic processes are typically pushed close to the limit of resolution in order to create maximum circuit density. Typical device geometries call for line widths on the order of 0.5 $\mu$M. Since these geometries are photolithographically produced, it is important that the wafer surface be highly planar in order to accurately focus the illumination radiation at a single plane of focus to achieve precise imaging over the entire surface of the wafer. A wafer surface that is not sufficiently planar, will result in structures that are poorly defined, with the circuits either being nonfunctional or, at best, exhibiting less than optimum performance. To alleviate these problems, the wafer is "planarized" at various points in the process to minimize non-planar topography and its adverse effects. As additional levels are added to multilevel-interconnection schemes and circuit features are scaled to submicron dimensions, the required degree of planarization increases. As circuit dimensions are reduced, interconnect levels must be globally planarized to produce a reliable, high density device. Planarization can be implemented in either the conductor or the dielectric layers.

In order to achieve the degree of planarity required to produce high density integrated circuits, chemical-mechanical planarization processes ("CMP") are being employed with increasing frequency. A conventional rotational CMP apparatus includes a wafer carrier for holding a semiconductor wafer. A soft, resilient pad is typically placed between the wafer carrier and the wafer, and the wafer is generally held against the resilient pad by a partial vacuum. The wafer carrier is designed to be continuously rotated by a drive motor. In addition, the wafer carrier typically is also designed for transverse movement. The rotational and transverse movement is intended to reduce variability in material removal rates over the surface of the wafer. The apparatus further includes a rotating platen on which is mounted a polishing pad. The platen is relatively large in comparison to the wafer, so that during the CMP process, the wafer may be moved across the surface of the polishing pad by the wafer carrier. A polishing slurry containing chemically-reactive solution, in which are suspended abrasive particles, is deposited through a supply tube onto the surface of the polishing pad.

CMP is advantageous because it can be performed efficiently, in contrast to past planarization techniques which are complex, involving multiple steps. Moreover, CMP has been demonstrated to maintain high material removal rates of high surface features and low removal rates of low surface features, thus allowing for uniform planarization. CMP can also be used to remove different layers of material and various surface defects. CMP thus can improve the quality and reliability of the ICs formed on the wafer.

Many other limitations, however, exist with CMP. Specifically, CMP often involves a large polishing pad, which uses a large quantity of slurry material. The large polishing pad is often difficult to control and requires expensive and difficult to control slurries. Additionally, the large polishing pad is often difficult to remove and replace. The large pad is also expensive and consumes a large foot print in the fabrication facility. These and other limitations still exist with CMP and the like.

What is needed is an improvement of the CMP technique to improve the degree of global planarity that can be achieved using CMP.

SUMMARY OF THE INVENTION

According to specific embodiments of the present invention, a technique including an apparatus for chemical mechanical planarization of objects is provided. In an exemplary embodiment, the invention provides an apparatus, which allows the polishing pad to be easily replaced. The apparatus includes a smaller polishing pad, relative to the size of the object being polished.

In a specific embodiment, the present invention provides an apparatus for chemical mechanical planarization. The apparatus has a platen assembly for holding an object (e.g., wafer, disk, flat panel, glass) to be planarized. The apparatus also has a polishing head coupled to a polishing pad, which has a smaller diameter than the object. The polishing head is movable (e.g., pivotable, rotatable, translational) from a first region overlying the platen assembly to a second region, which is outside the first region. A removable puck is coupled between the polishing pad and the polishing head.

The removable puck is removably coupled to a coupling on the polishing head. The apparatus also has a first magazine disposed in the second region. The first magazine houses at least one puck comprising a first polishing pad to be placed on the coupling on the polishing head. In a specific embodiment, the magazine houses a polishing pad or a plurality of them to be used to replace a used, worn, or faulty polishing pad in an improved manner.

In accordance with an aspect of the present invention, a system for chemical mechanical planarization comprises a platen assembly for holding an object to be planarized and a polishing head comprising a puck holder assembly for coupling to a substrate for holding a polishing pad. The polishing pad is smaller in surface area than the object. The polishing head is movable from a first region overlying the platen assembly to a second region. The puck holder assembly comprises a backing surface for positioning the substrate, and a clamp ring positioned proximate to the backing surface for supplying mechanical force to the substrate to hold the substrate in place during a polishing operation.

In accordance with another aspect of the invention, a chemical mechanical planarization apparatus comprises a housing including a backing surface for positioning a substrate holding a polishing pad which is smaller in surface area than an object to be planarized by the polishing pad in a polishing operation. A clamp ring is positioned in the housing proximate to the backing surface and being movable between a contracted position to clamp the perimeter of the substrate and an expanded position to release the substrate. A spring mechanism is disposed in the housing for resiliently biasing the clamp ring toward the contracted position.

In accordance with another aspect of the invention, a method for chemical mechanical planarization of an object comprises coupling a polishing head to a substrate for holding a polishing pad which is smaller in area than the object. A resilient mechanical force is applied to the perimeter of the substrate with the polishing head to hold the substrate in place during a polishing operation. The polishing pad is placed in contact with the object and rotated with the polishing head.

Numerous benefits are achieved by way of the present invention over other techniques. In some embodiments, the present invention provides an improved way to attach and remove the polishing pad. Additionally, the invention provides an improved technique for the manufacture of objects. In other embodiments, specific embodiments of the invention provide an easy way to replace used or worn or faulty polishing pads. Depending upon the embodiment, one or more of these benefits may exist. These and others will be described in more detail throughout the present specification and more particularly below.

Embodiments of the present invention achieve these benefits in the context of known process technology and known techniques in the mechanical arts. However, a further understanding of the nature and advantages of the present invention may be realized by reference to the latter portions of the specification and attached drawings.

DESCRIPTION OF THE SPECIFIC EMBODIMENTS

According to specific embodiments of the present invention, a technique including an apparatus for chemical mechanical planarization of objects is provided. In an exemplary embodiment, the invention provides an apparatus, which allows the polishing pad to be easily replaced. The apparatus includes a smaller polishing pad, relative to the size of the object being polished.

Figure 1A:
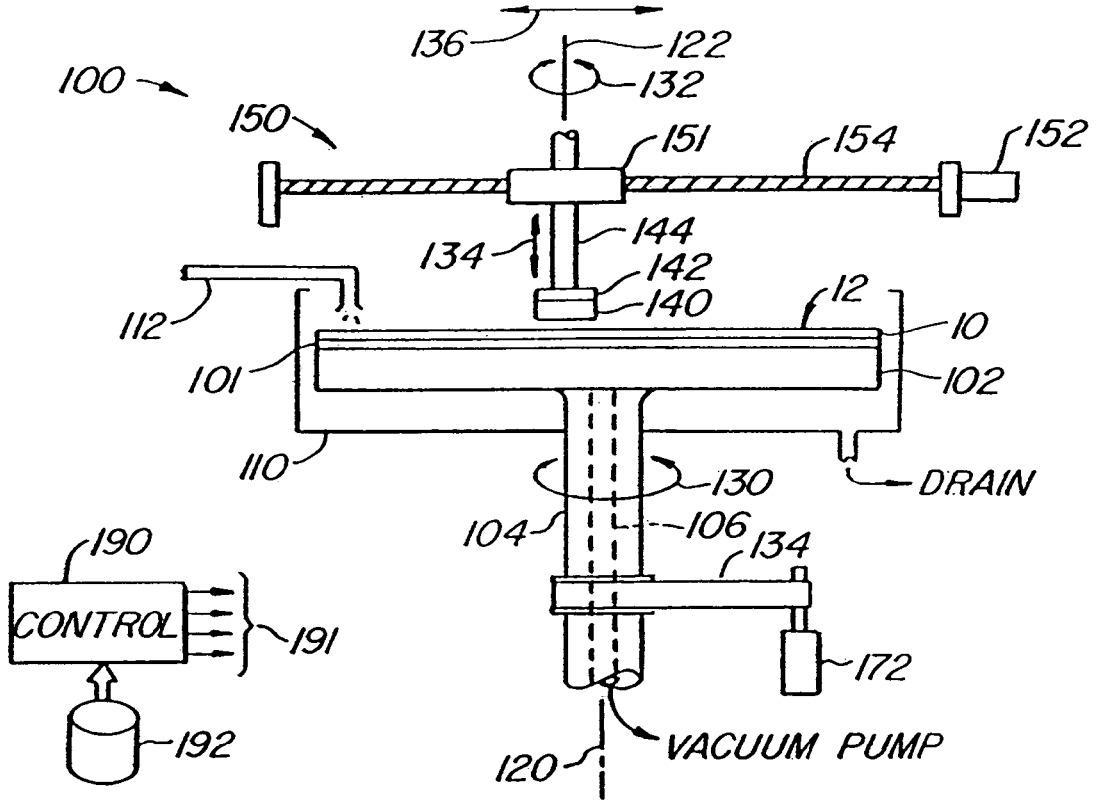
FIG. 1A is a simplified polishing apparatus according to an embodiment of the present invention.

Referring to FIG. 1A, a chemical-mechanical polishing apparatus 100 according to the embodiment shown includes a chuck 102 for holding a wafer 10 in position during a polishing operation. The apparatus shown is merely an example and has been simplified to facilitate a discussion of the salient aspects of the invention. As such, the figure should not unduly limit the scope of the claims herein. One of ordinary skill in the art would recognize many other variations, alternatives, and modifications.

The chuck includes a drive spindle 104 which is coupled to a motor 172 via a drive belt 174 to rotate the wafer about its axis 120. Preferably, the motor is a variable-speed device so that the rotational speed of the wafer can be varied. In addition, the direction of rotation of the motor can be reversed so that the wafer can be spun in either a clockwise direction or a counterclockwise direction. Typically, stepper motors are used since their speed can be easily controlled, as well as their direction of rotation. Servo motors can also be used, in other applications.

A channel 106 formed through spindle 104 is coupled to a vacuum pump (not shown). Chuck 102 may be a porous material, open to ambient at its upper surface so that air drawn in from the surface through channel 106 creates a low pressure region near the surface. A wafer placed on the chuck surface is consequently held in place by the resulting vacuum created between the wafer and the chuck. Alternatively, chuck 102 may be a solid material having numerous channels formed through the upper surface, each having a path to channel 106, again with the result that a wafer placed atop the chuck will be held in position by a vacuum. Such vacuum-type chucks are known and any of a variety of designs can be used with the invention. In fact, mechanical clamp chucks can be used. However, these types are less desirable because the delicate surfaces of the wafer to be polished can be easily damaged by the clamping mechanism. In general, any equivalent method for securing the wafer in a stationary position and allowing the wafer to be rotated would be equally effective for practicing the invention.

A wafer backing film 101 is disposed atop the surface of chuck 102. The backing film is a polyurethane material. The material provides compliant support structure which is typically required when polishing a wafer. High spots on a wafer prevent the pad from contacting the thinner areas (low spots) of the wafer. The compliant backing material permits the wafer to deflect enough to flatten its face against the polish pad. There can be a deflection of several thousands of an inch deflection under standard polishing forces. Polyurethane is not necessary, however, as any appropriate compliant support material will work equally well. In addition, the wafer typically includes a pressure sensitive adhesive (PSA) film on its bottom surface for coupling with the chuck 102. The PSA film desirably includes a plurality of holes that may be formed by laser to permit application of a vacuum from the chuck 102 on the bottom of the wafer.

FIG. 1A also shows a polishing pad assembly comprising a polishing pad 140, a chuck 142 for securing the pad in position, and a pad spindle 144 coupled to the chuck for rotation of the pad about its axis 122. In the embodiment shown, the pad diameter is less than the diameter of wafer 10, typically 20% of the wafer diameter. A drive motor (not shown) is coupled to pad spindle 144 to provide rotation of the pad. Preferably, the drive motor is a variable-speed device so that the rotational speed of pad 140 during a particular polishing operation can be controlled. The drive motor preferably is reversible.

Figure 1B:
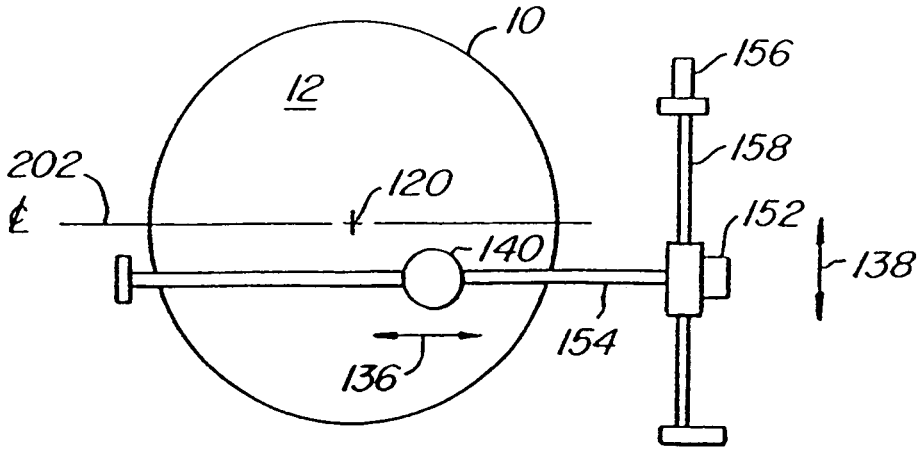
FIG. 1B is an alternative detailed diagram of a polishing apparatus according to an embodiment of the present invention.

Referring to FIGS. 1A and 1B, a traverse mechanism 150 provides translational displacement of the polishing pad assembly across the wafer surface. In one embodiment of the invention, the traverse mechanism is an x-y translation stage that includes a platform 151 for carrying the pad assembly. The traverse mechanism 150 further includes drive screws 154 and 158, each respectively driven by motors 152 and 156 to move platform 151. Motors 152 and 156 respectively translate platform 151 in the x-direction, indicated by reference numeral 136, and in the y-direction, indicated by reference numeral 138. Motors 152 and 156 preferably are variable-speed devices so that the translation speed can be controlled during polishing. Stepper motors are typically used to provide high accuracy translation and repeatability.

It is noted that the function of traverse mechanism 150 can be provided by other known translation mechanisms as alternatives to the aforementioned x-y translation stage. Alternative mechanisms include pulley-driven devices and pneumatically operated mechanisms. The present invention would be equally effective regardless of the particular mechanical implementation selected for the translation mechanism.

Figure 2:
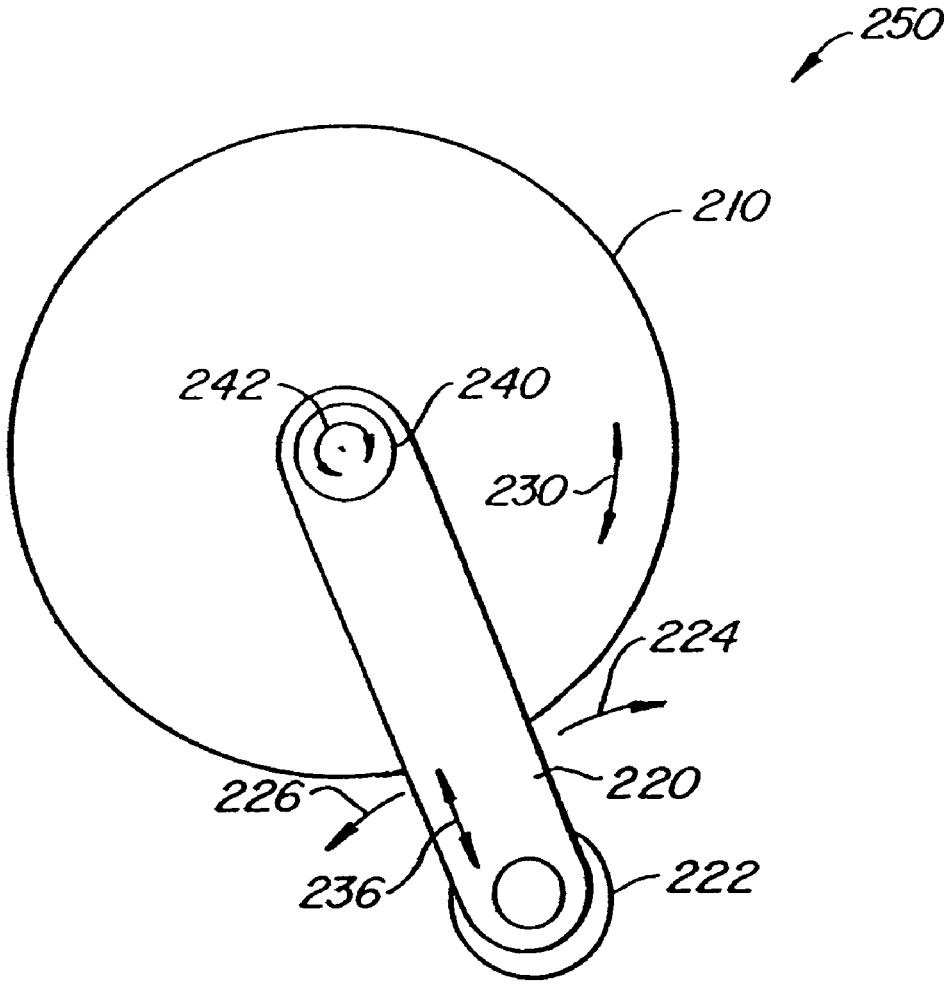
FIG. 2 is a simplified top plan view of a polishing apparatus according to another embodiment of the present invention.

For example, FIG. 2 shows another traverse mechanism 250 which provides angular displacement of the polishing pad assembly across the surface of the wafer 210. A rotational arm 220 is driven by an actuator 222 to rotate the polishing pad 240 coupled to its end, as indicated by arrows 224, 226. The pad 240 spins around its axis as shown by arrows 242. The wafer 210 rotates as shown by arrows 230. These rotations allow the pad 240 to contact and planarize the entire surface of the wafer 210. An optional translation of the arm 220 to move the pad 240 along arrows 236 may be provided.

Continuing with FIG. 1A, the pad 140 is oriented relative to wafer 10 such that process surface 12 of the wafer is substantially horizontal and faces upwardly. The polishing surface of pad 140 is lowered onto process surface 12 of the wafer. This arrangement of wafer surface to pad surface is preferred. If a power failure occurs, the various components in the CMP apparatus will likely cease to operate. In particular, the vacuum system is likely to stop functioning. Consequently, wafer 10 will no longer be held securely in place by vacuum chuck 102. However, since the wafer is already in a neutral position, the wafer will not fall and become damaged when the chuck loses vacuum but will simply rest upon the chuck.

The pad assembly is arranged on the translation stage of traverse mechanism 150 to allow for motion in the vertical direction which is indicated in FIG. 1A by reference numeral 134. This allows for lowering the pad onto the wafer surface for the polishing operation. Preferably, the pad assembly is driven by an actuator (e.g., a piston-driven mechanism) having variable-force control in order to control the downward pressure of the pad upon the wafer surface. The actuator is typically equipped with a force transducer to provide a downforce measurement which can be readily converted to a pad pressure reading. Numerous pressure-sensing actuator designs, known in the relevant engineering arts, can be used.

A slurry delivery mechanism 112 is provided to dispense a polishing slurry onto process surface 12 of wafer 10 during a polishing operation. Although FIG. 1A shows a single dispenser 122, additional dispensers may be provided depending on the polishing requirements of the wafer. Polishing slurries are known in the art. For example, typical slurries include a mixture of colloidal silica or dispersed alumina in an alkaline solution such as KOH, $NH_4OH$ or $CeO_2$. Alternatively, slurry-less pad systems can be used.

A splash shield 110 is provided to catch the polishing fluids and to protect the surrounding equipment from the caustic properties of any slurries that might be used during polishing. The shield material can be polypropylene or stainless steel, or some other stable compound that is resistant to the corrosive nature of polishing fluids.

A controller 190 in communication with a data store 192 issues various control signals 191 to the foregoing-described components of polishing apparatus 100. The controller provides the sequencing control and manipulation signals to the mechanics to effectuate a polishing operation. The data store 192 preferably is externally accessible. This permits user-supplied data to be loaded into the data store to provide polishing apparatus 100 with the parameters for performing a polishing operation. This aspect of the preferred embodiment will be further discussed below.

Any of a variety of controller configurations are contemplated for the present invention. The particular configuration will depend on considerations such as throughput requirements, available footprint for the apparatus, system features other than those specific to the invention, implementation costs, and the like. In one embodiment, controller 190 is a personal computer loaded with control software. The personal computer includes various interface circuits to each component of polishing apparatus 100. The control software communicates with these components via the interface circuits to control apparatus 100 during a polishing operation. In this embodiment, data store 192 can be an internal hard drive containing desired polishing parameters. User-supplied parameters can be keyed in manually via a keyboard (not shown). Alternatively, data store 192 is a floppy drive in which case the parameters can be determined elsewhere, stored on a floppy disk, and carried over to the personal computer. In yet another alternative, data store 192 is a remote disk server accessed over a local area network. In still yet another alternative, the data store is a remote computer accessed over the Internet; for example, by way of the world wide web, via an FTP (file transfer protocol) site, and so on.

In another embodiment, controller 190 includes one or more microcontrollers which cooperate to perform a polishing sequence in accordance with the embodiment of the invention. Data store 192 serves as a source of externally-provided data to the microcontrollers so they can perform the polish in accordance with user-supplied polishing parameters. It should be apparent that numerous configurations for providing user-supplied polishing parameters are possible. Similarly, it should be clear that numerous approaches for controlling the constituent components of the CMP are possible.

Additionally, the chemical mechanical polishing apparatus 100 includes a base panel 501, which houses a variety of systems and sub-systems. The base panel 501 is a frame support structure, which has doors for enclosing the frame support structure. The panel has a region, which houses a variety of sites used for replacing polishing pads according to as aspect of the present invention. As shown in FIG. 2, the sites include a disposal site 502, where the polishing pad can be removed. The removable polishing pad is described in commonly assigned U.S. application Ser. No. 09/432,882, filed on Nov. 2, 1999, now U.S. Pat. No. 6,227,956, which is hereby incorporated by reference in its entirety. The movable polishing pad is also described in more detail below. The disposal site can also include a device, such as the handling arms described below, which are used to remove the polishing pad and cap from the polishing head. Here, the polishing pad completes a polishing process, is elevated, and traverses to the disposal site 502, where the handling arms clamp the cap, the drive motor turns the drive shaft to free the cap, and the polishing head lifts up to free itself from the cap. Next, the arms release the cap, including the pad, into the disposal site. In a specific embodiment, the disposal site can be covered when it is not in use to prevent particulate contamination from being released from the disposal site to the object. Further details of the disposal site are provided below.

The apparatus also includes a variety of other sites. For example, the sites include a site 513, which holds new caps, each with a polishing pad. In a specific embodiment, the cap can be a hard pad material. In other embodiments, the sites also include one for new caps 509, each with a polishing pad for a soft pad. The soft pad can be made from a suitable material. Here, the apparatus can be attached to a hard pad for a specific application. Then, the apparatus can be attached to a soft pad, or alternatively, if desirable. Further details of the magazine are provided below.

The apparatus also includes a site 511 for conditioning the pad. The conditioning site has a conditioning pad and/or conditioning solution. The conditioning pad can include a diamond like pad, or the like. The conditioning pad can also include movement to help move away residual material from the polishing pad. In other embodiments, the conditioning pad can also be immersed in solvent, which is used to carry away residual material. Further details of the conditioning site are provided below.

Figure 3:
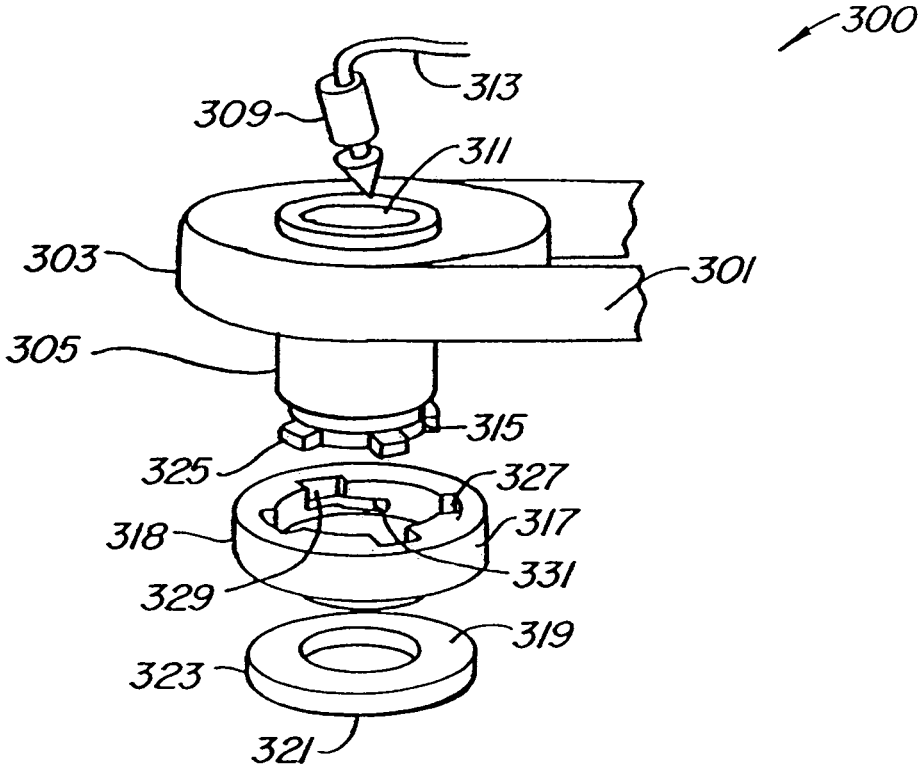
FIG. 3 is a simplified diagram of a drive and cap assembly according to an embodiment of the present invention.

FIG. 3 is a simplified diagram of a drive and cap assembly on a polishing head 300 according to an embodiment of the present invention. The assembly is merely an example and has been simplified to facilitate a discussion of the salient aspects of the invention. As such, the figure should not unduly limit the scope of the claims herein. One of ordinary skill in the art would recognize many other variations, alternatives, and modifications. As shown, the polishing head 300 includes a variety of features such as a support structure 301, which couples to a support. Additionally, the polishing head includes a drive device 303, which couples to a drive shaft 305. The drive shaft has a first end, which is attached to the drive device, and a second end, which includes a coupling 315. The coupling mates to a removable cap 317, which includes an outer region 318. The removable cap rotatably attaches to the coupling in a secure manner. Although the present cap is rotatable, there can be other ways of attaching the cap to the coupling. The rotatable cap also has a polishing pad 323, which can be fixed to the cap before it is secured to the coupling. The polishing pad may have an opening 321, but can also be one continuous member. The top surface 319 of the pad contacts the cap to secure it in place.

Now to secure the removable cap onto the coupling, the cap is brought into contact and is aligned to the coupling. Here, each of the threads 325 is aligned with a respective thread opening 327, inserted along a first direction toward the support structure, until each thread bottoms against a stop 329 in the opening. Next, the cap is rotated in a counter clockwise manner, where the groove 331 guides each thread such that the cap biases against the coupling to secure it in place. Once the cap is secured, the drive 305 rotates the pad in a counter clockwise circular manner during a process operation. By way of the counter clockwise manner, the cap does not loosen up and continues to be biased against the coupling. In other embodiments, the rotatable cap and coupling are mated to each other in a clockwise manner, where the drive rotates the pad in a clockwise manner.

To remove the cap from the coupling, the drive is secured in place manually or by a brake, where the rotatable coupling cannot be rotated through the drive. The cap is grasped and turned in a clockwise manner, which guides each thread away from the bias to release the cap from the coupling. Once each thread is aligned with its opening, the cap is dropped to free it from the coupling. Again, in other embodiments, the rotatable cap and coupling have been mated to each other in a clockwise manner, where the drive rotates the pad in a clockwise manner. In a preferred embodiment, the present cap is removed from the coupling by way of the technique illustrated by FIG. 4 below. This technique provides an automatic or "hands free" approach to removing the cap from the coupling.

The present cap, which is rotatably attached, can be replaced by other types of coupling devices. Of course, the type of coupling device used depends upon the application.

The polishing head also includes a sensing device 309, which is coupled to a processing unit, such as the one noted but can be others. The sensing device can look through an inner opening 311 of the drive shaft 305 to the polishing pad. In some embodiments, the polishing pad is annular in structure with an opening 321 in the center. The opening allows the sensor to sense a fluid level or slurry level at the workpiece surface, which is exposed through the center opening in the pad. Of course, the type of coupling device used depends upon the application.

Figure 3A:
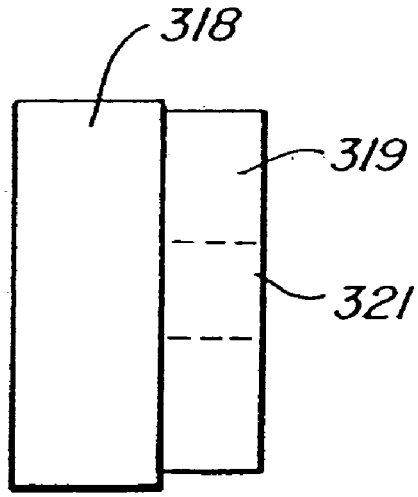
FIG. 3A is a simplified diagram of a combined cap and pad assembly according to an embodiment of the present invention.

FIG. 3A is a simplified diagram of a combined cap and pad assembly according to an embodiment of the present invention. This diagram is merely an illustration, which should not limit the scope of the claims herein. One of ordinary skill in the art would recognize many other variations, modifications, and alternatives. In a specific embodiment, the removable cap and polishing pad are in an assembly. The assembly is provided to the manufacturer of integrated circuits, for example, for use with the present polishing apparatus. The assembly can be pre-packaged in a clean room pack. The assembly can include the cap 318 and the pad 319, which may include an inner orifice or opening 321. Depending upon the embodiment, the pad can be one of a variety according to the present invention.

The cap can be made of a suitable material to withstand both chemical and physical conditions. Here, the cap can be made of a suitable material. The cap is also preferably transparent, which allows the sensing device to pick up optical signals from the workpiece surface. The cap is also sufficiently rigid to withstand torque from the drive shaft. The cap can also withstand exposure to acids, bases, water, and other types of chemicals, depending upon the embodiment. The cap also has a resilient outer surface to prevent it from damage from slurries, abrasive, and other physical materials. Further details of removing the cap are provided below.

Figure 4:
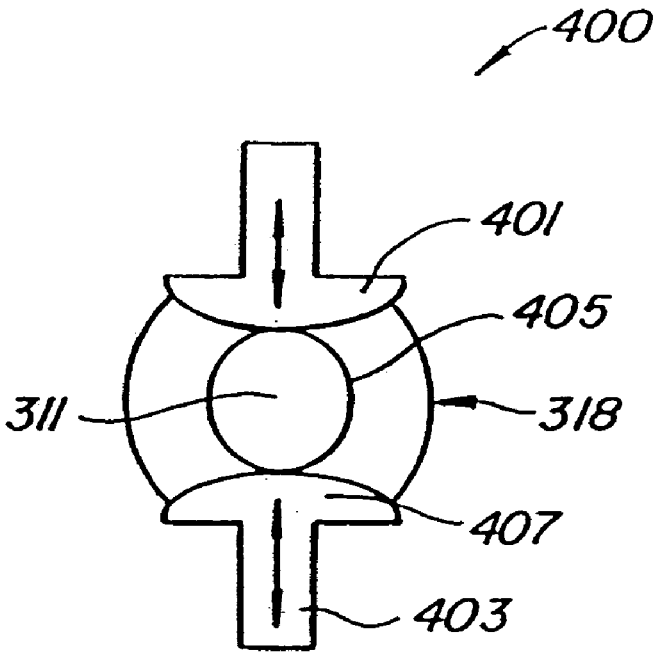
FIG. 4 is a simplified diagram of a polishing pad according to an embodiment of the present invention.

FIG. 4 is a simplified diagram of a polishing pad device 400 according to an embodiment of the present invention. The device is merely an example and has been simplified to facilitate a discussion of the salient aspects of the invention. As such, the figure should not unduly limit the scope of the claims herein. One of ordinary skill in the art would recognize many other variations, alternatives, and modifications. In a preferred embodiment to remove the cap, the cap 318 is placed between two handling arms 401, 403. Each of the arms places a lateral force against the cap to hold it in place. The motor drives the drive shaft in a clockwise (or counter clockwise) manner to release the threads of the cap from the coupling. Once the threads have been released the drive shaft is lifted to free the cap from the coupling.

Next, the removed cap is placed into a disposal. Here, the handling arms can move the cap from a removal location to a disposal location.

Figure 5:
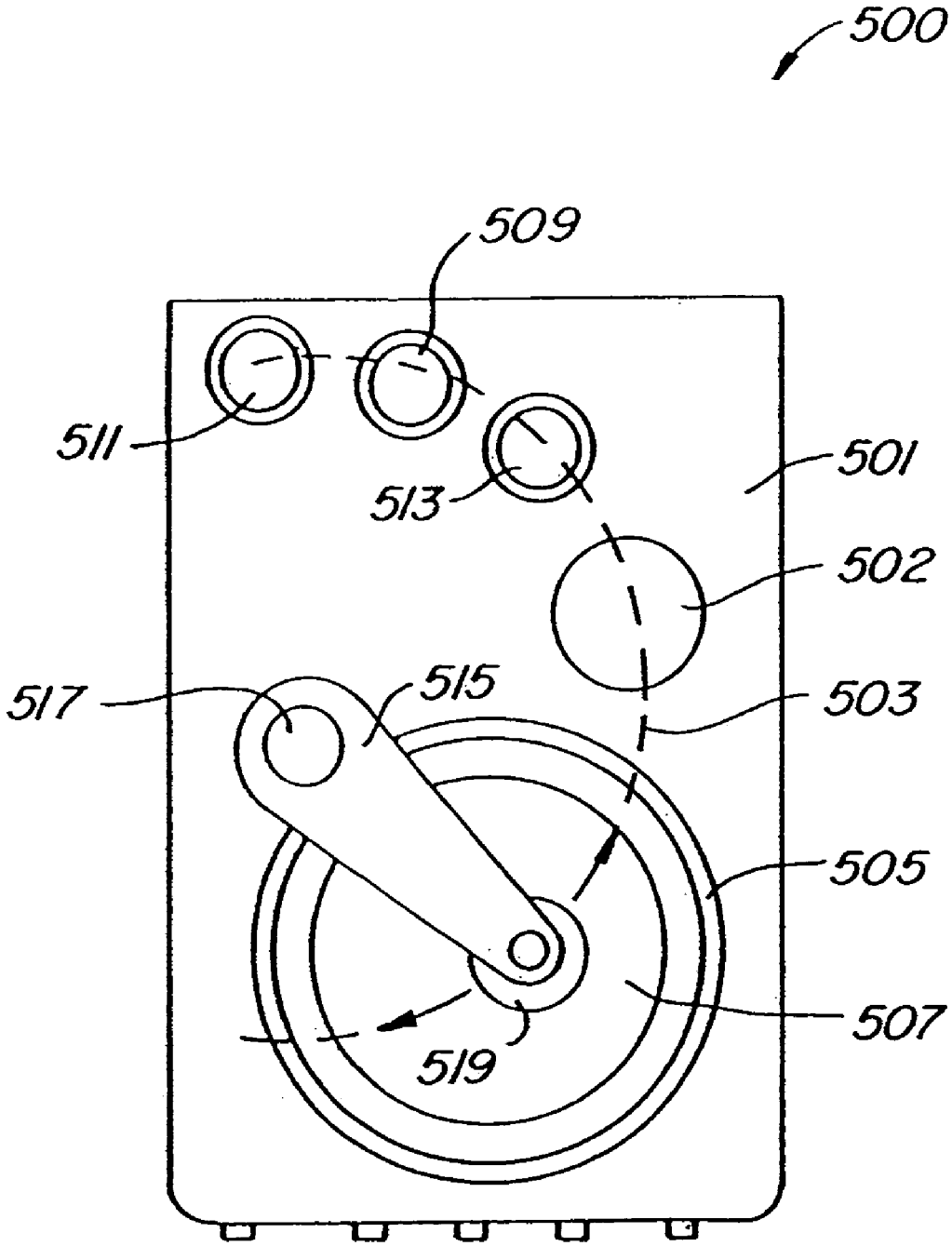
FIG. 5 is a simplified diagram of a polishing apparatus according to an alternative embodiment of the present invention.

FIG. 5 is a simplified top view diagram 500 of a multi-pad CMP apparatus according to an embodiment of the present invention. This diagram is merely example, which should not limit the scope of the claims herein. One of ordinary skill in the art would recognizes many other variations, modifications, and alternatives. As shown, the diagram 500 illustrates a top-view of a base panel 501, which houses a variety of systems and sub-systems. The base panel 501 is a frame support structure, which has doors for enclosing the frame support structure.

The panel includes a polishing head 515 (or arm), which pivots about member 517. The polishing head extends from member 517 to a region overlying the object 507 to be polished. The object can be a variety of work pieces, such as a semiconductor wafer, a glass plate, a flat panel, a blank wafer, a disk, and other objects with surfaces that need polishing or planarization. The object often rests on and is attached to a base plate or platen 505. The base plate can often rotate the object in either direction. Additionally, the base plate can ramp up in speed, or step up in speed, or perform other functions.

The polishing head includes a polishing pad 19, which is coupled to the polishing head. The polishing pad rotates in a circular or orbital manner and traverses across the surface of the object. The polishing pad can also move in the vertical direction to a selected height. Other functions of the polishing pad have been previously noted and also apply here, but should not unduly limit this embodiment.

The polishing pad can move from the object to one of a plurality of sites. These sites include a disposal site 502, where the polishing pad can be removed. The disposal site can also include a device, such as the handling arms, which are used to remove the polishing pad and cap from the polishing head. Here, the polishing arm completes a polishing process, is elevated, and traverse to the disposal site 502, where the handling arms clamp the cap, the drive motor turns the drive shaft to free the cap, and the polishing head lifts up to free itself from the cap. Next, the arms release the cap, including the pad, into the disposal site. In a specific embodiment, the disposal site can be covered, when it is not in use to prevent particulate contamination from being released from the disposal site to the object.

Figure 6:
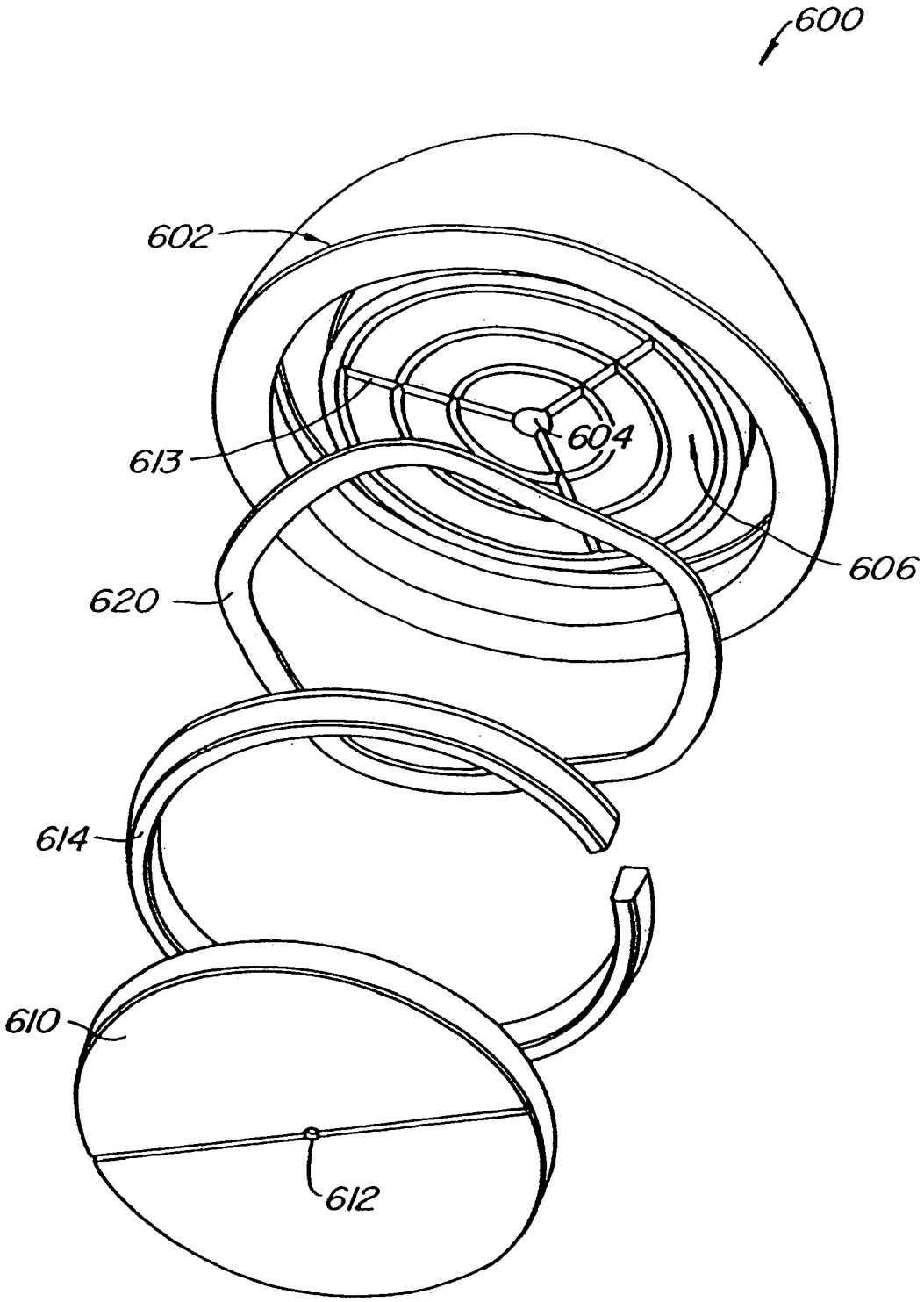
FIG. 6 is an exploded perspective view of a polishing head according to still an alternative embodiment of the present invention.

FIG. 6 is a simplified sectional view of a polishing head 600 according to still another embodiment of the present invention. This figure is merely an example which should not limit the scope of the claims herein. One of ordinary skill in the art would recognize many other variations, modifications, and alternatives.

The polishing head 600 includes a housing 602 including a backing surface 606 for positioning a polishing pad puck or substrate 610 for supporting a polishing pad. The substrate 610 is desirably a hard substrate made of a substantially firm and rigid material such as metal, plastic, or the like. The substrate 610 may be an insulator or a semiconductor. A channel 604 in the housing 602 and an orifice 612 in the substrate 610 may be provided for injecting a polishing slurry onto the wafer surface for polishing. The backing surface 606 desirably is planar for supporting a planar backside of the substrate 610. A pattern of release grooves 613 are desirably provided on the backing surface 606 for assisting ejection of the substrate 610 as described below. FIG. 6 shows a pattern having radial and annular grooves 613, but other patterns may be used.

A clamp ring 614 is disposed around the substrate 610 for clamping the substrate 610 around its perimeter. As shown in FIG. 6, the clamp ring 614 has a split-ring arrangement with a slit which permits it to expand to release the substrate 610 and contract to clamp the substrate 610. The clamp ring 614 in a neutral or relaxed state tends to expand, and is constrained to a contracted state inside the space provided in the housing 602. Of course, other split-ring arrangements may be used in alternative embodiments.

Figure 7:
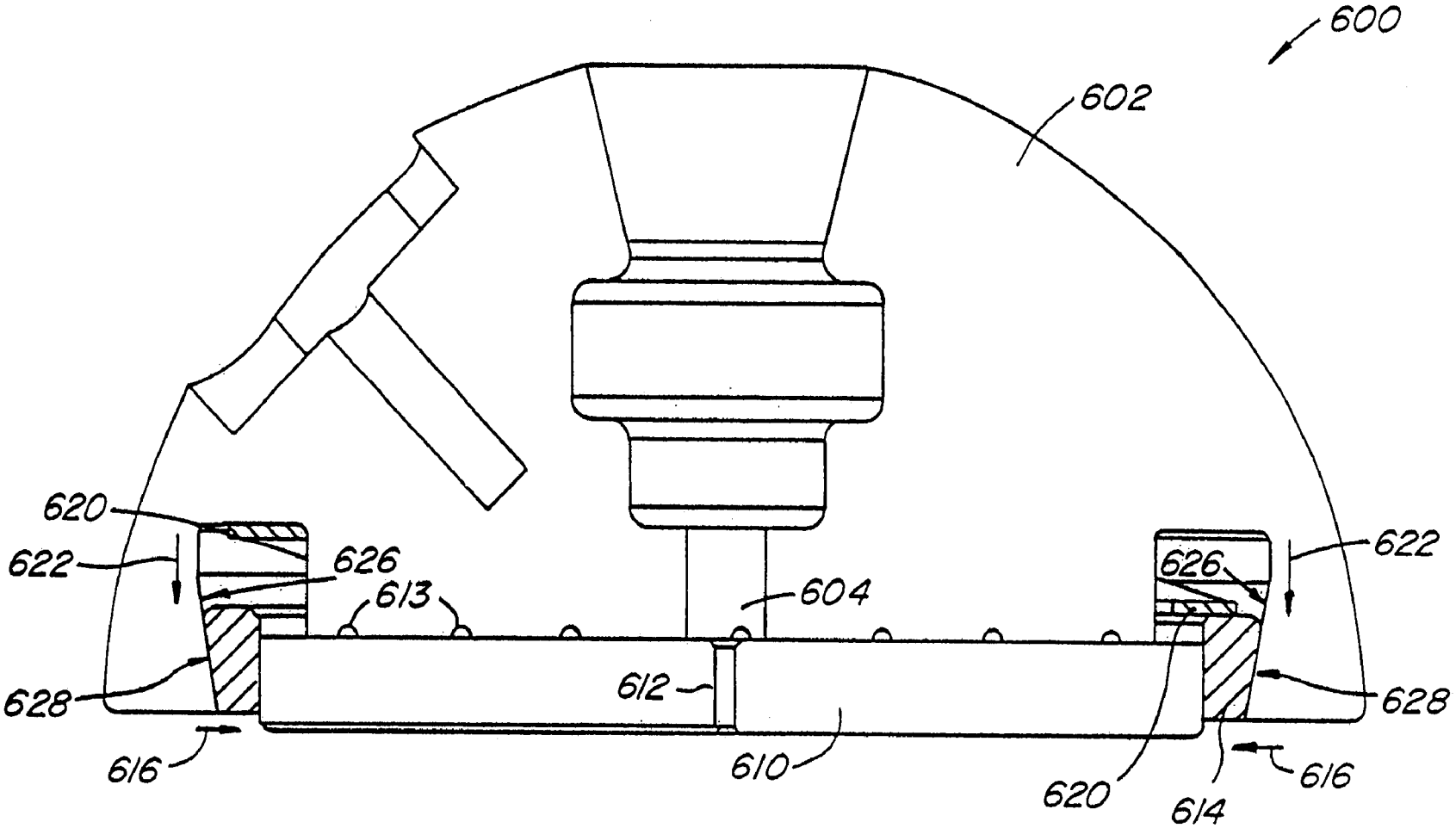
FIG. 7 is a cross-sectional view of the polishing head of FIG. 6.

An annular wave spring 620 is used to applying a spring force on the clamp ring 614 for clamping the substrate 610, as shown in FIG. 7. The direction of the spring force 622 is generally perpendicular to the directions 616 of the clamping force of the clamp ring 614. To produce the transverse clamping force from the spring force, the housing 602 includes a slanted guide surface 626 to provide guiding support for the inclined surface 628 of the clamp ring 614. Guided by the slanted guide surface 626, the clamp ring 614 contracts when it is pushed downward by the spring 620 to clamp around the perimeter of the substrate 610, and expands when it is moved against the spring 620 to release the substrate 610. The wave spring 620 may be replaced by other resilient members including, for example, an elastomer member, a coil spring, a pneumatic cylinder, or a bladder.

Figure 8:
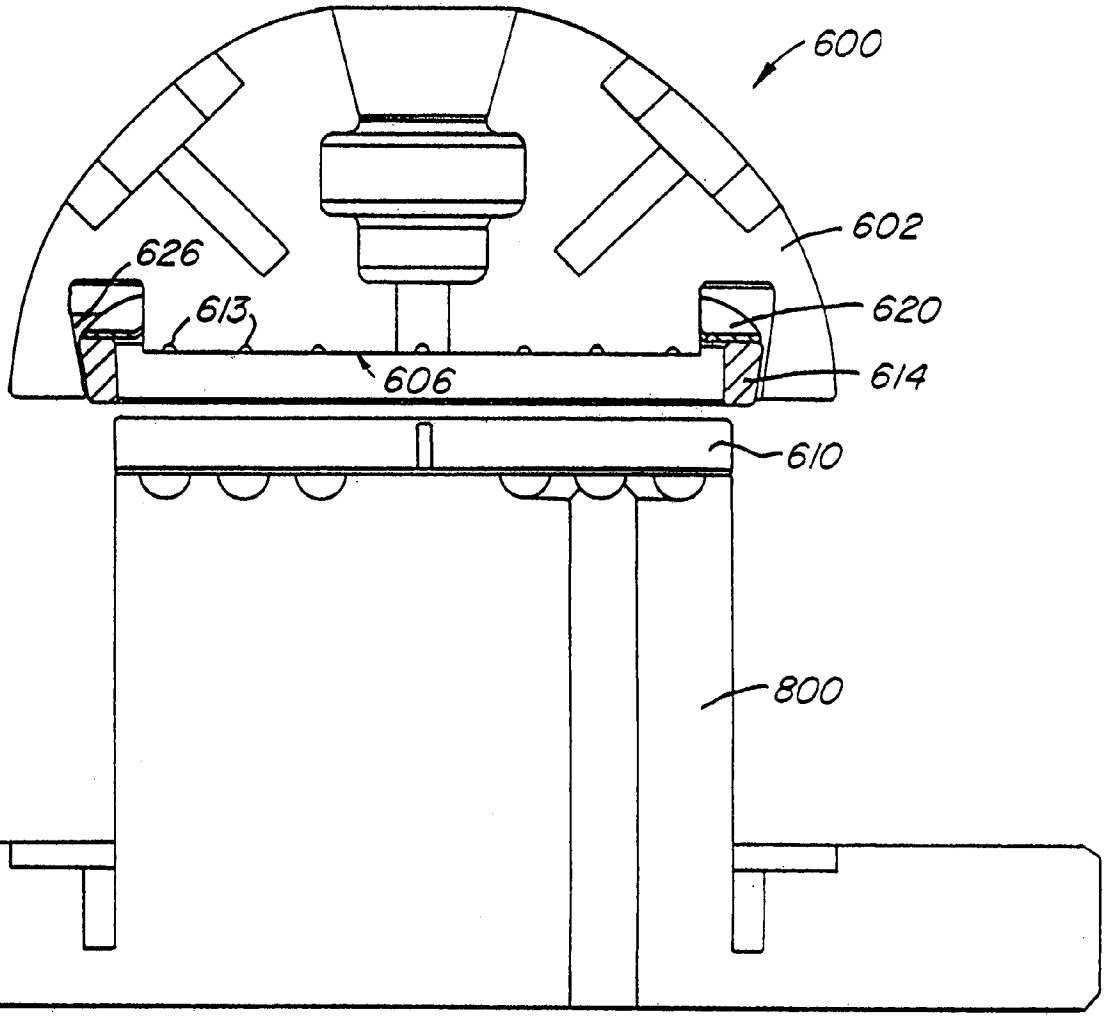
FIG. 8 is a cross-sectional view of the polishing head of FIG. 6 illustrating loading of a puck disposed on a pickup stand.
Figure 8A:
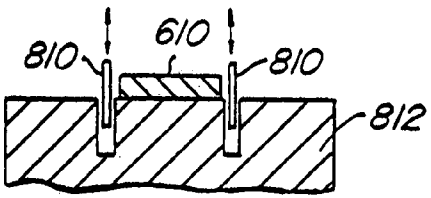
FIG. 8A is a simplified sectional view illustrating another embodiment of the pickup stand.
Figure 8B:
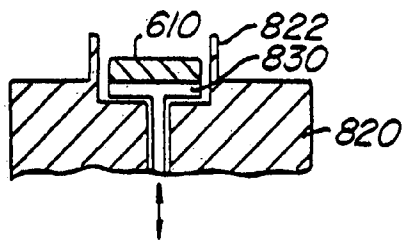
FIG. 8B is a simplified sectional view illustrating another embodiment of the pickup stand.

To load the substrate 610, the housing 602 is pushed downward onto the substrate 610 disposed on a loading or pickup stand or load platform 800 as shown in FIG. 8. The substrate 610 pushes the clamp ring 614 upward against the annular wave spring 620. This causes the clamp ring 614 to move up along the slanted guide surface 626 until the clamp ring 614 expands beyond the perimeter of the substrate 610. After the clamp ring 614 clears the substrate 610, the clamp ring 614 then slides or snaps down around the perimeter of the substrate 610 to clamp the substrate 610 which is supported at the backside by the backing surface 606 of the housing 602. Of course, other ways of loading the substrate 610 may be used. For instance, the clamp ring 614 may be pushed upward by one or more movable members 810 extending upward from the pickup stand 812, as shown in FIG. 8A, while the backside of the substrate 610 and the backing surface 606 are brought into contact with one another. The movable members 810 are then withdrawn to allow the clamp ring 614 to clamp the perimeter of the substrate 610. Alternatively, FIG. 8B shows a pickup stand 820 having an annular top 822 for pushing the clamp ring 614 upward as the polishing head 600 is moved downward to load the substrate 610. The clamp ring 614 expands to allow the backing surface 606 to contact the backside of the substrate 610. A substrate support 830 moves the substrate 610 upward against the backing surface 606 of the housing 602 with respect to the annular top 822 to allow the clamp ring 614 to move downward and clamp the perimeter of the substrate 610.

Figure 9A:
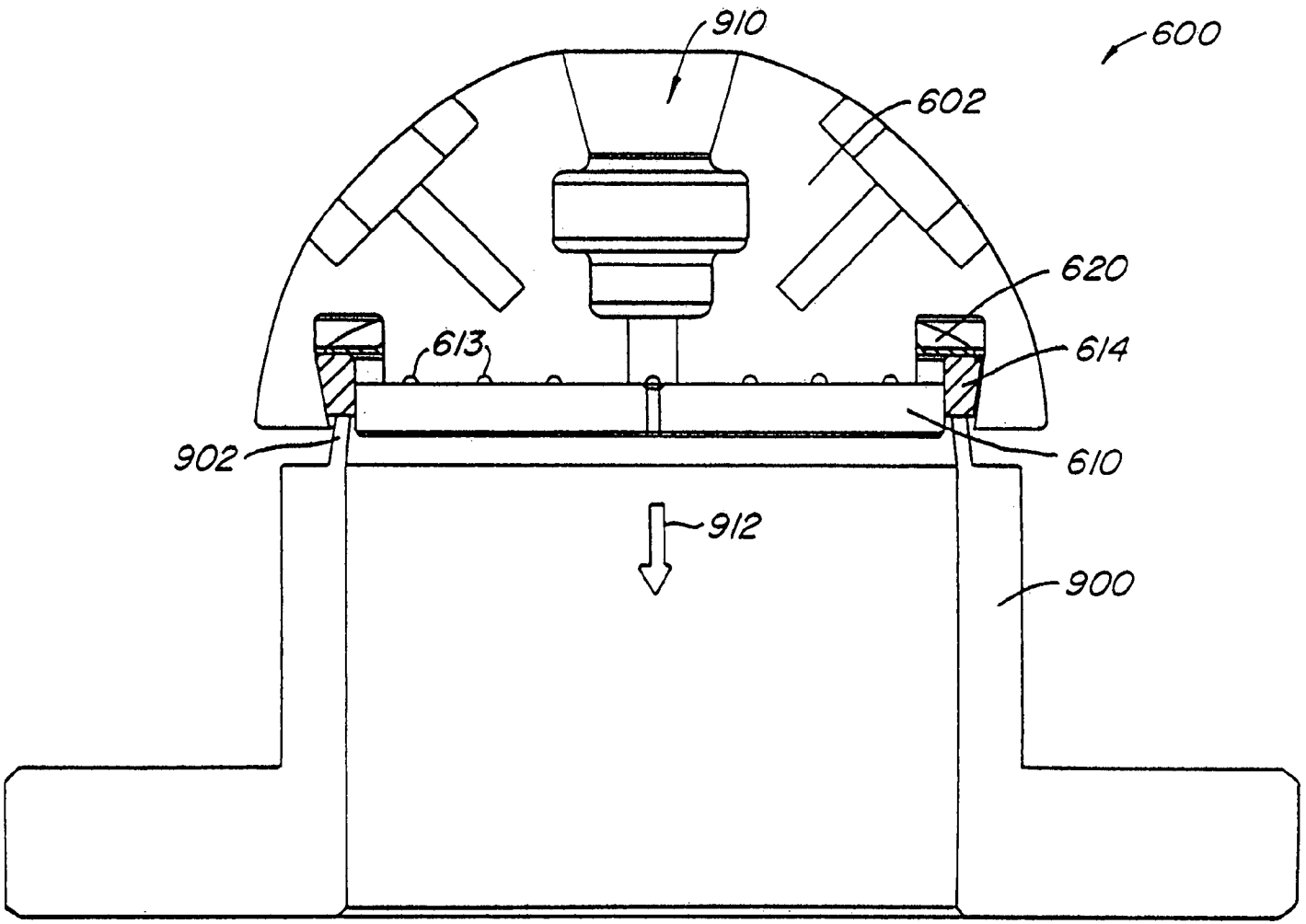
FIGS. 9A and 9B are cross-sectional views of the polishing head of FIG. 6 illustrating release of a puck onto a discharge or disposal stand.
Figure 9B:
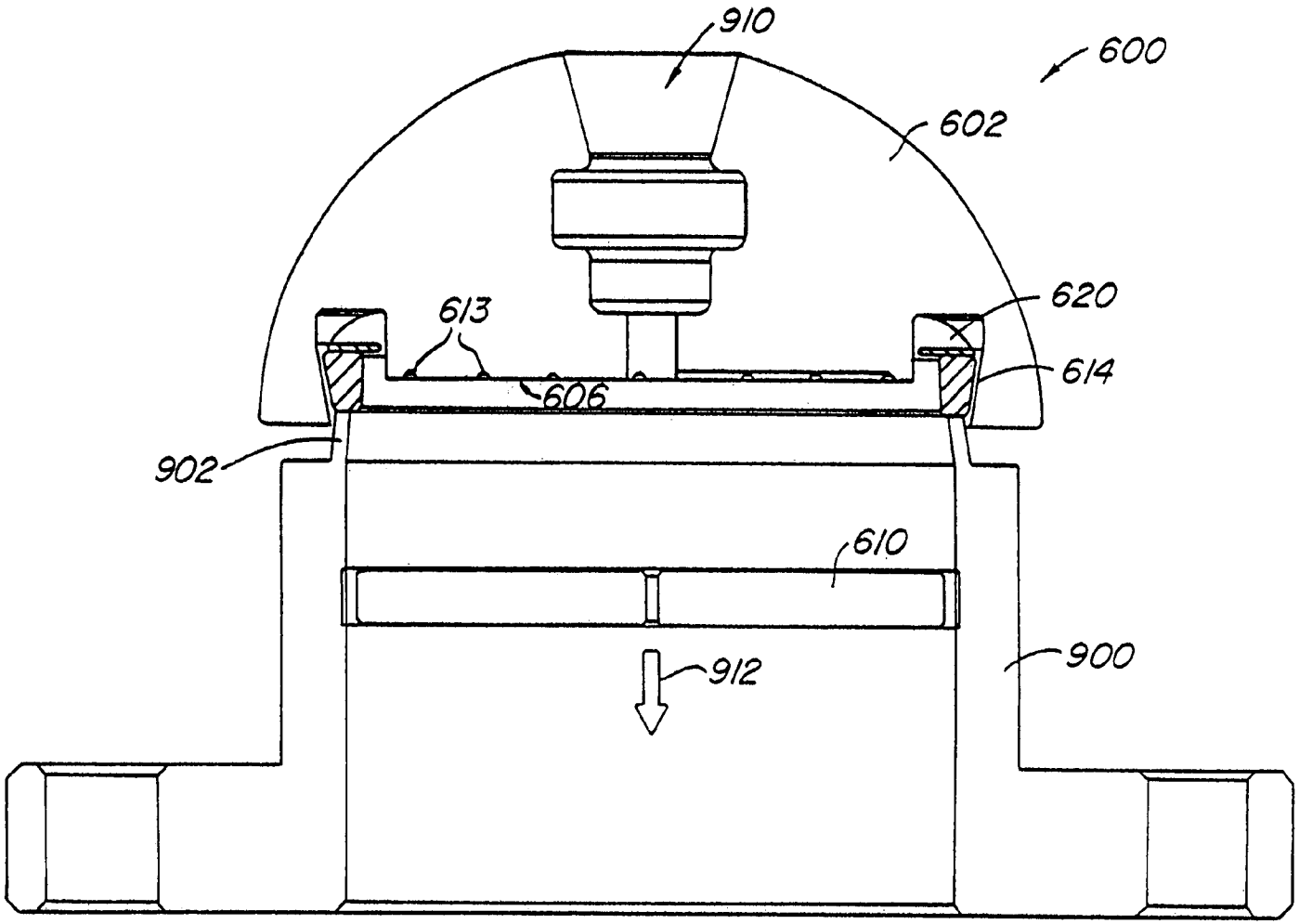

FIGS. 9A and 9B show a discharge or disposal station 900 for releasing the substrate 610, for instance, at the disposal site 502 (FIG. 5). This figure is merely an example which should not limit the scope of the claims herein. One of ordinary skill in the art would recognize many other variations, modifications, and alternatives. The discharge station 900 includes an annular top or release ring 902 for pushing the clamp ring 614 upward as the polishing head 600 is moved downward along the slanted guide surface 626. This causes the clamp ring 614 to expand to release the substrate 610 into the discharge station 900. To assist in the ejection of the substrate 610, a low pressure air puff may be used to break any surface tension between the substrate 610 and the backing surface 606 of the housing 602. The air puff is supplied through an air passage 910 and applied against the substrate 610 at the interface with the backing surface 606. To provide a more effective ejection, the air is channeled into the release grooves 613 on the backing surface 606 to allow the air to contact a greater area of the substrate 610. The ejected substrate 610 falls into the discharge station 900 along arrow 912 under gravity.

The split clamp ring mechanism enhances clamping force on the substrate and produces self-alignment of the substrate. The use of the annular wave spring provides self-energized clamping and release of the substrate. The clamp ring and spring may be made of a variety of materials. For example, the ring may include Delrin AF™ made by Dupont Corporation, PET. The spring may be-made of stainless steel or titanium.

Figures 10, 11:
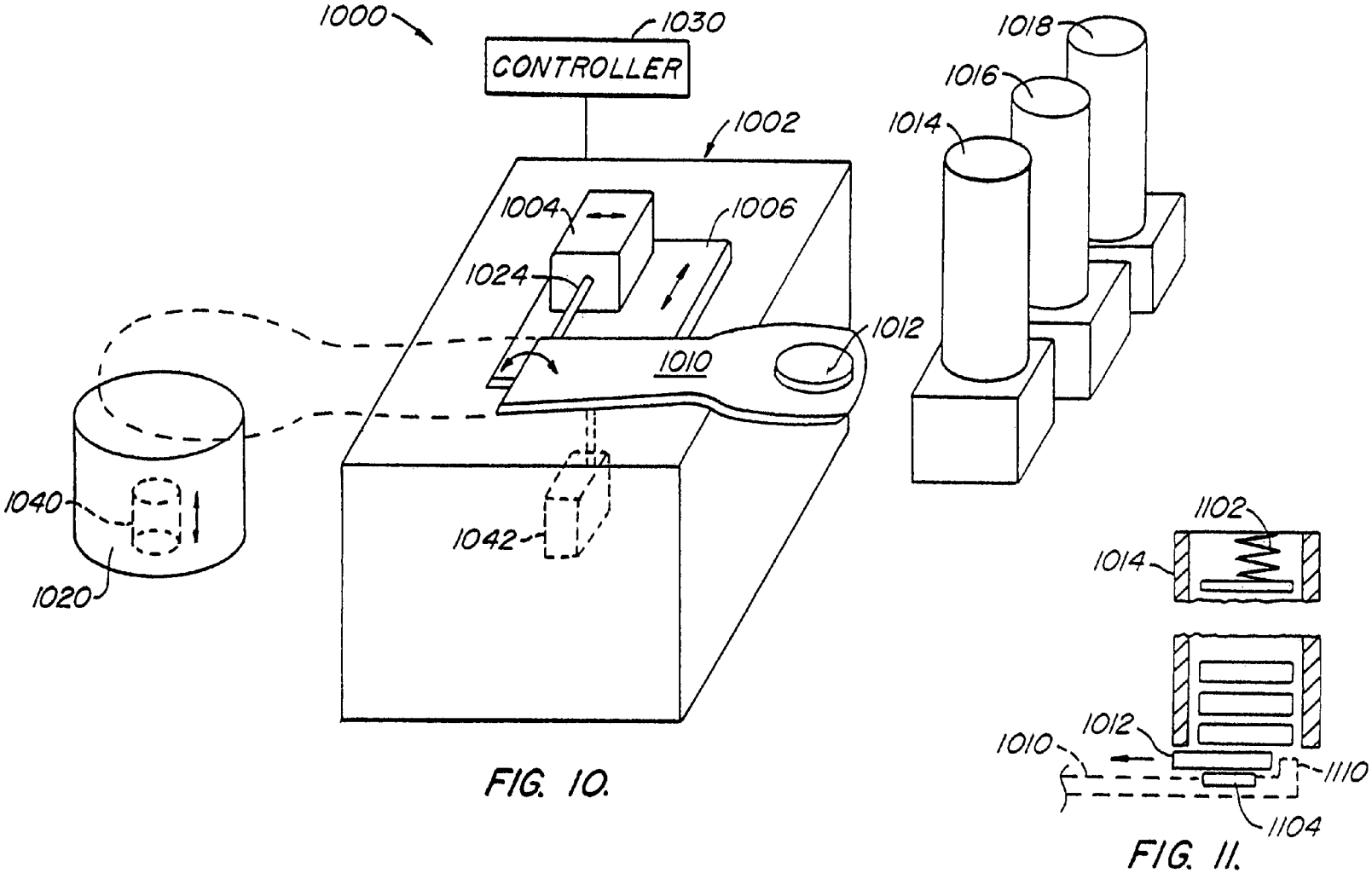
FIG. 10 is a simplified diagram of a puck transfer system according to an embodiment of the present invention.
FIG. 11 is a simplified sectional view of a puck magazine illustrating loading of a puck onto a puck support of the puck transfer system of FIG. 10.

FIG. 10 shows a diagram of a puck transfer system 1000 according to an embodiment of the present invention. This diagram is merely an example which should not limit the scope of the claims herein. One of ordinary skill in the art would recognize many other variations, modifications, and alternatives.

FIG. 10 shows a transfer apparatus 1002 having an x-actuator 1004 and a y-actuator 1006 for moving a puck or substrate support 1010 in the x-direction and the y-direction, respectively. For instance, the transfer apparatus 1002 may include an x-y stage that may be a stepper. The transfer apparatus 1002 manipulates the puck support 1010 to retrieve a polishing pad puck or substrate 1012 from one of the magazines 1014, 1016, 1018, and to transfer the puck to a pickup stand 1020. The different magazines may contain different pucks having different types of polishing pads. In one embodiment, a controller 1030 has a computer program containing instructions for directing operation of the transfer apparatus 1002 to select and retrieve pucks from the appropriate magazines. In the embodiment shown, the transfer apparatus 1002 includes an angular actuator 1024 for moving the puck support 1010 angularly from the region in which the magazines are located to the pickup stand 1020. The angular displacement is about 180° in one specific embodiment. Of course, a different transfer apparatus may be used in a different arrangement.

As shown in FIG. 11, the pucks are dispensed from the bottom of the magazine 1014. The magazine includes a bottom support 1104 at the bottom supporting the exposed puck 1012 from movement in a downward direction, and includes an opening permitting only the exposed puck 1012 to be moved out of the magazine 1014 by the puck support 1010. The pucks may be gravity fed, spring loaded by a spring 1102, or otherwise configured to render the pucks accessible by the puck support 1010 at the bottom one at a time. For instance, a portion of the backside of the puck facing downward is exposed. The backside of the puck is desirably flat and smooth. This configuration of the magazine 1014 allows for stacking of more pucks, which may be made of clear plastic, for example, by injection molding.

The transfer apparatus 1002 positions the puck support 1010 below the exposed puck 1012, for example, by sliding the puck support 1010 in the y-direction below the magazine 1014. The puck support 1010 includes a hook-like projection or raised edge 1110 which hooks on the rear edge of the exposed puck and slides it out of the magazine 1014 in the x-direction. To secure the puck in place, the puck support 1010 may include a vacuum port on the puck support surface coupled to a vacuum source to draw a suction on the puck against the support surface of the puck support 1010. Of course, other ways of securing the puck 1012 may be used.

After the x-actuator 1004 moves the substrate support 1010 in the x-direction away from the magazine 1014, the angular actuator 1024 rotates the substrate support 1010 to flip the puck 1012 onto the pickup stand 1020 from polish side up to polish side down, as seen in FIG. 10. The vacuum to the vacuum port is interrupted or removed to release the puck 1012 onto the pickup stand 1020. The pickup stand 1020 desirably includes a z-actuator 1040 for adjusting its height relative to the puck support 1010 and aligning the pickup stand 1020 in the z-direction to receive the puck 1012. Alternatively or additionally, the transfer apparatus 1002 may include a z-actuator 1042 instead to adjust the position of the puck support 1010 relative to the pickup stand 1020 in the z-direction.

The transfer system 1000 of FIGS. 10 and 11 are merely illustrative, and other mechanisms may be used instead. For example, the flipping of the puck support 1010 may be replaced by a puck support that is configured to remain generally horizontal during transfer of the puck from the puck supply to the pickup stand. The x-y stage may be replaced by an R-θ rotational traverse mechanism. The magazines providing bottom feeding of the pucks may be replaced by magazines with top feeding of the pucks.

While the above is a full description of the specific embodiments, various modifications, alternative constructions and equivalents known to those of ordinary skill in the relevant arts may be used. For example, while the description above is in terms of a semiconductor wafer, it would be possible to implement the present invention with almost any type of article having a surface or the like. Moreover, the use of the term cap and puck to refer to the substrate disposed between the polishing pad and the polishing head is not intended to limit the substrate to specific shapes or structures. Therefore, the above description and illustrations should not be taken as limiting the scope of the present invention which is defined by the appended claims.

What is claimed is:

1. A method for polishing an object, the method comprising:

coupling a polishing head to a substrate for supporting a polishing pad which is smaller in area than the object;

applying a resilient mechanical force to the perimeter of the substrate with the polishing head to hold the substrate in place during a polishing operation;

supporting the polishing pad by the substrate;

placing the polishing pad in contact with the object; and rotating the polishing pad with the polishing head.

2. The method of claim 1 wherein the substrate is coupled to a backing surface of the polishing head and the resilient mechanical force is applied to the perimeter of the substrate by a clamp ring proximate to the backing surface.

3. The method of claim 2 wherein the clamp ring is biased by a spring mechanism in the polishing head in a direction of a spring force perpendicular to the backing surface and is guided by a slanted guide surface in the polishing head to move inward toward the perimeter of the substrate as the clamp ring moves in the direction of the spring force.

4. The method of claim 3 wherein coupling the polishing head to the substrate comprises moving the substrate against the clamp ring toward the backing surface of the polishing head in a direction opposite from the spring force direction, the slanted guide surface of the polishing head guiding the clamp ring to move outward away from the perimeter of the substrate until the clamp ring expands beyond the perimeter of the substrate and slides over the perimeter, the spring mechanism biasing the clamp ring with the spring force and the slanted guide surface guiding the clamp ring to move inward toward the perimeter of the substrate to hold the perimeter of the substrate with a biasing mechanical force.

5. The method of claim 3 wherein coupling the polishing head to the substrate comprises:

applying a release force to the clamp ring to move the clamp ring in a release direction opposite from the spring force direction, the slanted guide surface of the polishing head guiding the clamp ring moving in the release direction to move outward away from the perimeter of the substrate until the clamp ring expands substantially to or beyond the perimeter of the substrate;

moving the substrate toward the backing surface of the polishing head; and removing the release force to permit the clamp ring to clamp the perimeter of the substrate.

6. The method of claim 3 further comprising decoupling the substrate from the polishing head by releasing the resilient mechanical force applied to the perimeter of the substrate.

7. The method of claim 6 wherein decoupling the substrate from the polishing head comprises applying a release force to the clamp ring to move the clamp ring in a release direction opposite from the spring force direction, the slanted guide surface of the polishing head guiding the clamp ring moving in the release direction to move outward away from the perimeter of the substrate until the clamp ring expands substantially to or beyond the perimeter of the substrate.

8. The method of claim 7 wherein the polishing head is coupled with a dump station having at least one protrusion disposed around a cavity, the protrusion applying the release force to the clamp ring to move the clamp ring in the release direction to decouple the substrate from the polishing head and release the substrate into the cavity of the dump station.

9. The method of claim 2 wherein decoupling the substrate from the polishing head comprises directing an air puff between the backing surface of the polishing head and the substrate.

* * * * *